United States Patent [19]

McMullen et al.

[11] Patent Number: 4,550,768

[45] Date of Patent: Nov. 5, 1985

[54] COMPACTABILITY MEASUREMENT METHOD AND APPARATUS FOR SAND CASTING

[75] Inventors: Carl R. McMullen, Waverly; Marshall S. Campbell, Chattanooga, both of Tenn.

[73] Assignee: Foundry Technology, Inc., Waverly, Tenn.

[21] Appl. No.: 470,566

[22] Filed: Feb. 28, 1983

[51] Int. Cl.[4] ..... B22C 25/00; B22D 46/00; B22D 47/02

[52] U.S. Cl. ..... 164/456; 73/291; 73/432 R; 164/150; 164/154; 164/155; 378/54

[58] Field of Search ..... 164/456, 5, 155, 154, 164/150; 340/621; 73/290 V, 291, 432 R, 432 Z; 378/54, 55, 56

[56] References Cited

U.S. PATENT DOCUMENTS

| | | | |
|---|---|---|---|
| 2,679,317 | 5/1954 | Roop | 209/560 |
| 2,756,476 | 7/1956 | Moore | 164/456 X |
| 2,791,120 | 5/1957 | Dietert et al. | 164/456 X |
| 2,890,347 | 6/1959 | McCormick | 378/56 |
| 3,136,010 | 6/1964 | Dietert et al. | 164/154 X |
| 3,223,964 | 12/1965 | Stadlin | 164/154 X |
| 3,318,156 | 5/1967 | Dietert | 73/432 Z |
| 3,460,030 | 8/1969 | Brunton et al. | 324/58.5 A |
| 3,510,374 | 5/1970 | Walker | 164/154 X |
| 3,534,260 | 10/1970 | Walker | 324/58.5 A |
| 3,600,574 | 8/1971 | Glaza et al. | 164/5 X |
| 3,693,079 | 9/1972 | Walker | 378/53 |
| 4,108,188 | 8/1978 | McMullen et al. | 164/5 X |
| 4,121,646 | 10/1978 | Rikker | 164/456 |
| 4,141,404 | 2/1979 | McMullen | 164/5 X |
| 4,304,289 | 12/1981 | McMullen | 164/154 |

FOREIGN PATENT DOCUMENTS

| | | | |
|---|---|---|---|
| 827996 | 5/1981 | U.S.S.R. | 164/150 |

*Primary Examiner*—Nicholas P. Godici
*Assistant Examiner*—J. Reed Batten, Jr.
*Attorney, Agent, or Firm*—Kerkam, Stowell, Kondracki & Clarke

[57] ABSTRACT

A compactability system measures the compactability of granular material such as sand as used in a sand casting foundry system. The compactability is displayed on a meter, recorded by a chart recorder, and used for controlling plows to insure that unacceptable sand is not fed into molding machines. The compactability is determined by initially determining density by passing gamma radiation through the granular material as it moves on a conveyor belt. The attenuation of the gamma radiation is dependent upon the density of the granular material and the depth of the granular material. A plow is used to insure that the depth of the granular material is controlled such that the radiation and attenuation will be an accurate indication of the sand density of the loose or uncompacted sand. This sand density is subtracted from an empirical value representative of the density of the compacted sand, and the difference is thereby divided by the empirical value, thereby deriving a compactability signal.

28 Claims, 2 Drawing Figures

COMPACTABILITY MEASUREMENT METHOD AND APPARATUS FOR SAND CASTING

BACKGROUND OF THE INVENTION

1. Field of the Invention

This invention relates to compactability measurement for sand in a sand casting foundry system. More specifically, this invention relates to non-contact continuous measurement of sand compactability used in a foundry sand casting system.

2. Description of the Prior Art

The use of sand casting for a foundry system is well known in the art. In particular, the sand is fed into a molding machine and serves as a mold for casting a molten metal article. Following the hardening of the molten metal article, most of the sand is recycled into a sand mixer or muller wherein water, binder, and additional sand are added. The additional sand replaces sand which has been lost in the recycling operation, as by sticking to the metal article produced by the molding process. The recycled sand is fed from the sand mixer into the molding machine to complete the loop.

One of the problems associated with sand casting is the need to insure that the sand is suitable for use in the molding process. If the sand does not have the proper characteristics for functioning in the molding process, all or part of a production line may have to be shut down in order to remedy the problem. Additionally, materials may be wasted in producing a metallic article which is not acceptable.

One of the more important characteristics of the sand used in a sand casting operation is the compactability of the sand. The compactability, which usually is between 35 and 55 percent for most foundry operations, is a measure of how much the sand can be compacted during the molding process. Compactability may be expressed as a ratio of the difference between the compacted sand density and the non-compacted sand density to the compacted sand density.

Compactability in the industry has traditionally been measured by taking a sample of sand either before or after preparation for molding. Generally, a prepared sample is taken somewhere between the mixer and the molding machine. The sample is screened or fluffed into a standard cylinder and raked level on the top. The sand is then rammed three times with a two kilogram weight. Percent compactability is computed by measuring the travel of the ram.

It should be understood that the compactability measurement by ramming is actually taking a ratio of non-compacted volume to compacted volume. However, for a given amount of material, the percentage change in volume will be equal to the percentage change in density. This is true because the density is defined as mass over volume and, therefore, for a given amount of mass, the density times the volume will always be constant. Accordingly, the ram technique allows one to measure compactability by measuring a change in volume.

The prior art further includes numerous techniques for measuring various characteristics of materials. The following patents disclose several such techniques:

| U.S. Pat. No. | Inventor (s) | Date Issued |
|---|---|---|
| 3,534,260 | Walker | Oct. 13, 1970 |

-continued

| U.S. Pat. No. | Inventor (s) | Date Issued |
|---|---|---|
| 3,136,010 | Dietert et al | June 9, 1964 |
| 3,460,030 | Brunton et al | Aug. 5, 1969 |
| 3,693,079 | Walker | Sept. 19, 1972 |
| 3,600,574 | Glaza et al | Aug. 17, 1971 |
| 3,223,964 | Stadlin | Dec. 14, 1965 |
| 2,890,347 | McCormick | June 9, 1959 |
| 2,679,317 | Roop | May 25, 1954 |
| 3,510,374 | Walker | May 5, 1970 |

The Roop patent discloses an X-ray system which tracks property changes as a particular object or material degrades. A prior measurement of the same property of the object may be used as a reference for comparison purposes.

The McCormick patent shows the use of an X-ray measuring system wherein the absorption of X-rays in the test material is compared with the absorption in a standard specimen.

The Dietert et al patent shows a sand casting moldability measurement system using a balance plate. The measurement of the moldability, which is defined therein as dependent upon the amount of sand which passes through a screen relative to the amount of sand which passes completely over the screen, is used for controlling the addition of an additive to the sand mixer. As an alternative to moving the sand across a vibrating screen for determining moldability, the sand is compressed and the bending strength of the compressed sand is measured to provide an indirect measurement of the sand moldability.

The Stadlin patent discloses an ultrasonic measurement system for determining height of a granular material.

The Brunton et al patent discloses a moisture percentage measurement using both microwaves and gamma rays. This system computes a ratio of a voltage dependent upon the sand moisture content and a voltage dependent upon the moist weight of the sand.

The Walker '374 patent discloses a feedback system for controlling and gauging a particular property in a processed material. The property or characteristic of a material used in a rubber calendaring process is gauged and the measured value is used for adjusting the material property as a function of a difference between the measured property and a target or desired value of the property.

The Walker '260 and '079 patents disclose the use of gamma rays in combination with microwaves for determining the moisture content of different materials.

The Glaza et al. patent discloses the use of a gamma detector in a sand chute. Specifically, a gamma source is disposed in a probe which extends into a sand chute and gamma detectors are located immediately outside of the chute. The gamma rays are used to determine the sand density, whereas a neutron source and neutron detector is used to detect the amount of water in the sand.

In addition to checking the compactability by the ram measurement test discussed above, the prior art further includes taking a sample of sand off the conveyor belt between a sand mixer and the molding machine and making a drop weight. Alternately, the sample is run through a groove wheel with a second displaceable wheel which rides in the groove, the displacement of the second wheel being dependent upon the compactability of the sand.

Although the prior art techniques have been generally useful at determining particular properties or characteristics of materials, they have been generally subject to one or more serious disadvantages.

One disadvantage common to many prior art measurement techniques is the requirement for removing a sample of the sand from the molding production line. If using a compactability measurement technique which actually compacts the sand, the sand must of necessity be removed from passage from the sand mixer to the molding machine. As is well known in the field, the molding machine requires loose or uncompacted sand to be fed into it.

In addition to the disadvantage of separating out sand from passage between the sand mixer and the molding machine, the prior art techniques which depend upon the mechanical compaction of the sand also are generally batch type techniques. That is, they do not provide a continuous measurement of compactability. Instead, the ram type compaction measurement technique and similar mechanical compaction methods usually require a set amount of sand to be fed into a chamber which is then compacted, compaction measurements being output only at the discrete times and for the discrete sample amounts of the sands which are measured during that particular batch. Depending upon the frequency of compactability measurements and whether the sample is truly representative of the overall sand, the measurement results may be of questionable accuracy.

A further disadvantage common to ram or other mechanical compactability measurement systems is that they require mechanically movable parts (e.g., the compressing ram) which require significant amounts of energy for their operation and which are subject to mechanical breakdown.

Another common disadvantage to many prior art techniques is the need for a human operator to initiate a measurement operation.

Although the prior art techniques discussed above include numerous techniques which are continuous measurement systems and avoid some of the disadvantages heretofore discussed, these prior art techniques do not determine the compactability of the sand. The compactability of the sand is dependent upon moisture content and numerous other factors such as its chemical composition and grain size. However, because the compactability is a relatively complex function of the moisture content, one cannot readily determine the compactability from knowledge of the moisture content alone.

SUMMARY OF THE INVENTION

Accordingly, it is an object of the present invention to provide for the non-batch measurement of compactability in a sand or, more generally, a granular material casting foundry system.

A further object of the present system is to provide a compactability measurement technique whereby mechanically movable parts are minimized in order to insure a high level of reliability.

A still further object of the present invention is to provide a sand casting compactability measurement technique wherein the sand may be measured without separating it from its normal production flow.

Yet another object of the present invention is to provide a sand or granular casting compactability measurement technique which is especially suitable for retrofitting existing sand casting production arrangements.

Another object of the present invention is to provide a compactability measuring technique wherein the compactability of the sand is continuously charted as the casting system operates.

A further object of the present invention is to provide compactability measurement without requiring a human operator to initiate the measurement.

A still further object of the present invention is to provide a compactability measurement system such that sand or similar granular material which is unsuitable for use in a molding machine is prevented from being inserted into the molding machine.

These and other objects of the present invention which will become apparent as the description proceeds are realized by a process including the steps of subjecting granular material in a granular material casting foundry system to radiation from a radiation source, detecting an amount of radiation which has passed through the granular material from the radiation source, using the detected radiation to derive a density signal dependent on the density of the granular material, and operating on the density signal with a standard density value to generate a compactability signal dependent on the compactability of the granular material. In accordance with the present invention the granular material is subjected to the radiation as it is moving from a mixer to at least one molding machine. The compactability is based on the compactability of all of the granular material moving from the mixer to the molding machine, and the subjecting, detecting and using steps are performed in non-batch fashion. The granular material is subjected to the radiation as it is moving on a conveyor belt. The method according to the present invention further comprises the step of continuously recording the compactability of the granular material. The method further comprises, before the granular material is subject to the radiation, the steps of placing the granular material on a conveyor belt, plowing the granular material to a level at or below a particular depth, detecting the depth after the plowing, and generating a depth signal depending on the detected depth. The method further comprises the step of generating a digital validity signal having a first valve indicating that the compactability signal is accurate when the depth signal indicates that the detected depth is at the particular depth and a second value indicating that the compactability signal is inaccurate when the depth signal indicates that the detected depth is below the particular height. The compactability signal is used for controlling the flow of granular material from the mixer to the molding machine by raising and lowering a plow depending upon the compactability signal. The radiation is gamma radiation, whereas the detecting of the depth is accomplished by directing ultrasonic waves towards the granular material and detecting reflected ultrasonic waves from the granular material. The method further includes comparing the compactability signal to a reference compactability value and generating a comparison signal based on the comparison. Broadly considered, the method steps of subjecting the granular material and detecting the radiation which has passed through the granular material are substeps within the step of measuring the density of granular material in the granular material casting foundry system.

The compactability measurement system of the present invention is adapted for use with a granular material casting foundry system and comprises a density detector for detecting in non-batch fashion the density of granular material as it is moving from a mixer to at least one molding machine of a foundry system, a density signal generator connected to the density detector for generating the density signal dependent on the detected density, and a compactability signal generator connected to receive the density signal from the density signal generator and operative for generating a compactability signal dependent on the density signal and a reference density value. The density detector comprises a radiation source and a radiation detector for detecting radiation which has passed through the granular material. A flow controller for controlling the flow of granular material from the mixer to the molding machine is movable between different positions dependent on the compactability signal. An aerator is disposed upstream from the density detector. The density detector detects density of the granular material as it moves on a conveyor belt and the present system further comprises a plow upstream from the density detector for plowing the granular material to a level at or below a particular depth, a depth detector between the plow and the density detector for detecting the depth of the granular material, and a depth signal generator for generating a depth signal depending on the detected depth. The depth detector is realized by an ultrasonic transmitter and an ultrasonic detector, whereas a validity signal generator receives the depth signal and generates a digital validity signal dependent on the depth signal. A recorder continuously records the compactability of the granular material. A comparison signal generator is operative to receive the compactability signal, compare the compactability signal to the reference compactability value, and generate a comparison signal based on the comparison.

BRIEF DESCRIPTION OF THE DRAWINGS

The present invention will best be understood by considering the detailed description of the invention in conjunction with the accompanying drawings wherein like numbers represent like parts throughout and in which.

DETAILED DESCRIPTION OF THE PREFERRED EMBODIMENT

Figure 1:
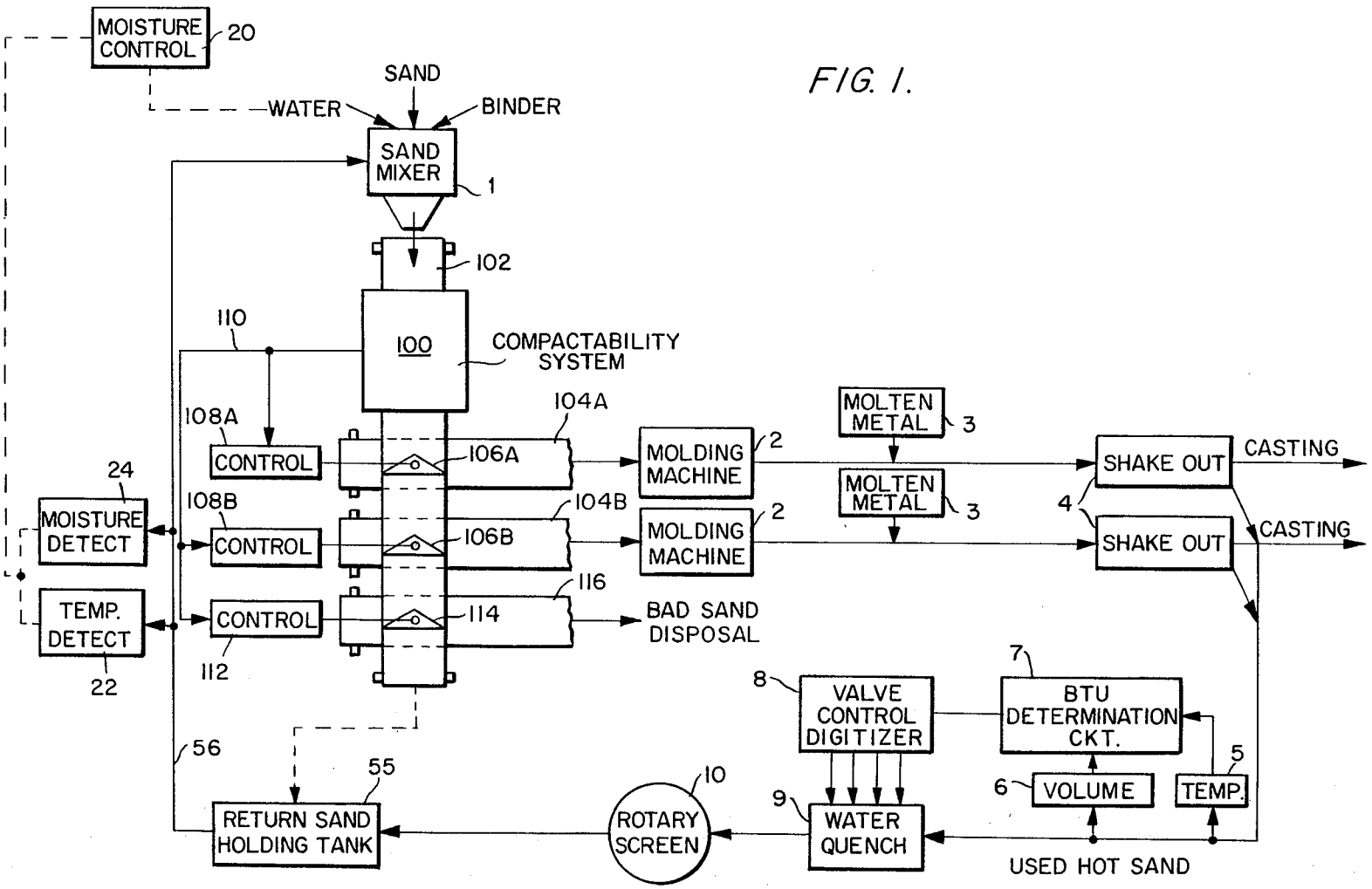
FIG. 1 shows a schematic representation of a sand casting foundry system having the compactability system 100 of the present invention inserted therein.

FIG. 1 illustrates a typical sand casting foundry system incorporating a compactability system 100 according to the present invention.

The basic granular material casting foundry system is disclosed in previous U.S. Pat. Nos. 4,141,404 filed July 25, 1977 and 4,304,289 filed June 27, 1979 by Carl R. McMullen. Also, U.S. Pat. No. 4,108,188 filed July 25, 1977 by Carl R. McMullen and Gary Schlageter discloses the basic foundry system. These patents are hereby incorporated by reference.

Most of the components of the basic sand casting foundry system of FIG. 1 are discussed in detail in one or more of the above referenced patents. Accordingly, a brief review of these components should be sufficient herein. Recycled sand is fed on line 56 into a sand mixer 1 wherein water, new sand, and binder may also be added. Following the mixing of the sand mixer 1, the sand is dispensed to one or more of the molding machines 2. The molding machines 2 use the sand to make a mold into which molten metal 3 is fed in a manner well known in the art. When the molten metal has hardened sufficiently, shake out 4 separates most of the sand of the mold from the casting, it being readily understood that some sand may adhere to the casting even after the shake out. The sand which has been separated from the casting is fed as used hot sand into a water quench 9 which is controlled by a valve controller 8 responsive to a temperature determination circuit 7 operating on signals supplied by volume detector 6 and temperature detector 5. The sand after quenching is fed into a sand holding tank 55 by way of a rotary screen 10. Sand from the holding tank 55 is fed along path 56 into the sand mixer 1 wherein this used sand is combined with water, binder, and new sand to replace that sand lost during the loop. Temperature detector 22 and moisture detector 24 feed signal to a moisture control circuit 20 which controls the addition of water to the sand mixer. The sand is conveyed from station to station by conveyor belts, although FIG. 1 simply shows lines connecting most stations in the loop.

As is conventional in a sand or granular material casting foundry system, a single mixer 1 may feed sand into more than one molding machine 2. Although only two molding machines 2 are shown in FIG. 1, it should be readily understood that additional molding machines may be arranged to receive sand from the mixer 1. The sand from the mixer 1 is placed upon the conveyor belt 102 from which it is distributed to conveyor belt 104A or conveyor belt 104B by operation of plows 106A or 106B. The plows 106A and 106B are raised and lowered depending upon control circuits 108A and 108B, it being understood that these circuits might simply be subcircuits within an overall plow controlling circuit. If the molding machine 2 associated with conveyor belt 104A is operating, the plow 106A will push sand off conveyor belt onto conveyor belt 104A in a manner well known in the art. Likewise, if the molding machine 2 associated with conveyor belt 104B is operating at a particular time, the plow 106B will cause sand to be deposited upon conveyor belt 104B. Control circuits 108A and 108B and plows 106A and 106B, which function as flow controllers, control the distribution or flow of granular material from the mixer 1 to the molding machines 2 according to the demands of the molding machines 2 in a manner well known in the art.

As shown in FIG. 1, the compactability system 100 of the present invention is mounted such that the conveyor belt 102 runs straight through it. The compactability measurement system 100 provides an input on line 110 to the control circuits 108A and 108B. Basically, the signal on line 110 will indicate whether the granular material proceeding through the compactability system 100 has an acceptable level of compactability. If the compactability is insufficient, control circuits 108A and 108B will raise the plows 106A and 106B in order to insure that the unacceptable sand is not fed into the molding machines 2. At the same time, the signal indicating unacceptable compactability will cause control 112 to lower plow 114 such that the bad sand will drop onto conveyor belt 116 from where it may proceed to a bad sand disposal tank or other disposal arrangement. If the compactability system of the present invention indicates that the compactability of the sand is acceptable, but none of the molding machines 2 currently require any sand, all of the plows 106A, 106B, and 114 will be raised and the sand flowing off the end of conveyor belt 102 may simply be fed back into the sand holding tank 55.

Figure 2:
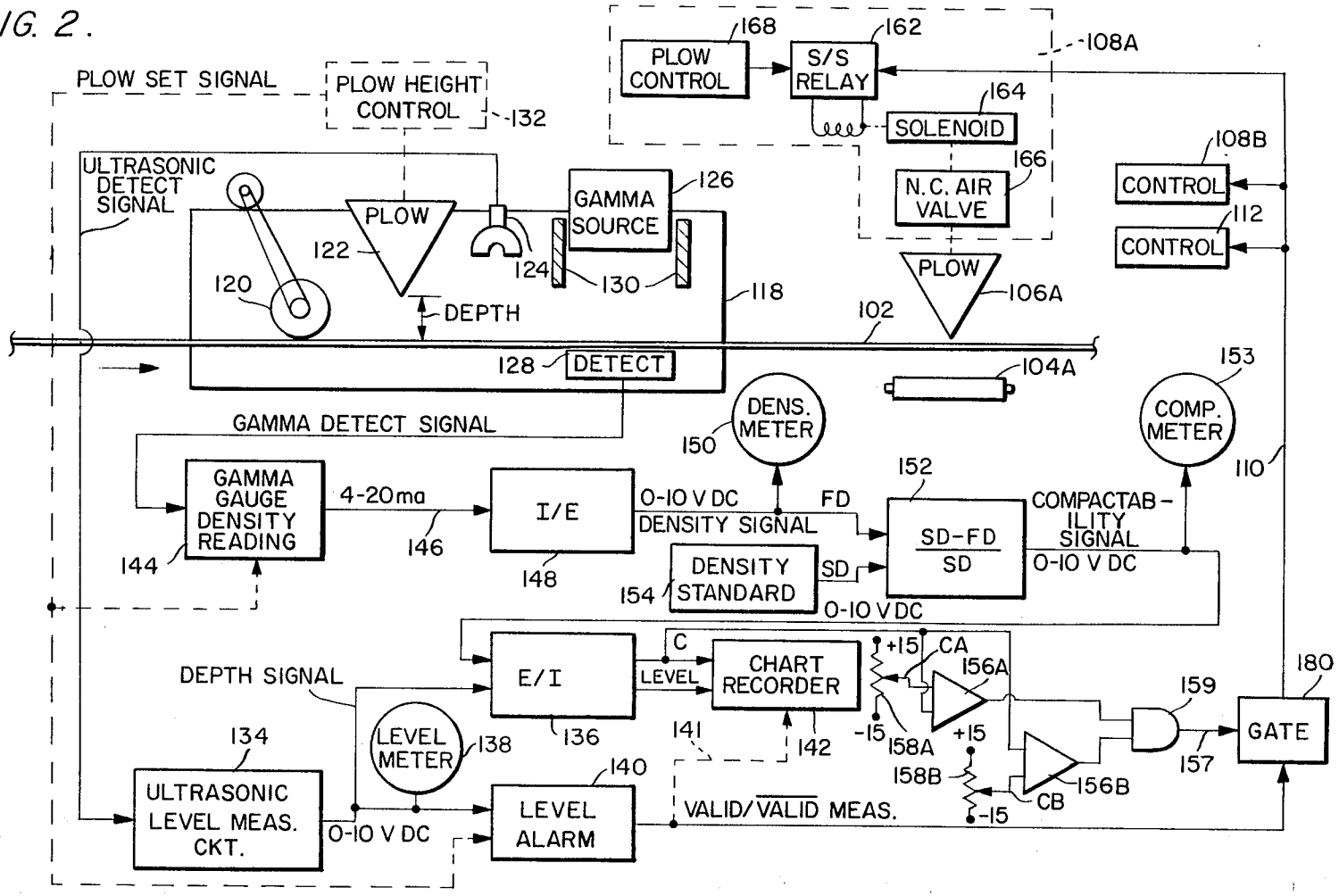
FIG. 2 shows the components of the compactability system of the present system.

Turning now to FIG. 2, there is shown the components which make up the compactability system 100 of the present invention. Specifically, the compactability measurement system 100 includes a housing 118 which is mounted such that conveyor belt 102 runs therethrough. Housing 118 includes an aerator fluffer 120 at its upstream end, a plow 122, an ultrasonic transmitter and receiving unit 124, and, at its downstream end, a gamma source 126 and associated gamma detector 128.

Radiation shielding 130 is used to insure that radiation from the gamma source will be prevented from leaking outside of the housing 118. The radiation shielding 130 is shown in simplified form for ease of illustration. As with the aerator 120, plow 122, ultrasonic combined transmitter and detector unit 124, gamma source 126 and gamma detector 128, radiation shielding is well known in the art and need not be discussed in detail.

The schematically illustrated plow 122 could be fixed in depth or manually adjustable to various depths. Alternately, plow 122 is controlled by plow height control 132 to automatically adjust the depth or height of sand to a desired value.

The ultrasonic combined transmitter and detector 124 generates an ultrasonic detect signal which is fed to ultrasonic level measuring circuit 134. The ultrasonic level measuring circuit uses the ultrasonic detect signal to produce a depth signal, the magnitude of which uniquely defines the depth of the sand in between the plow 122 and the gamma source 126. The depth signal is fed into a level meter 138 such that an operator of the foundry system may directly read the current level or depth of the granular material. Additionally, the depth signal is fed into a voltage to current converter 136 and converted into a current representative of the level or depth and is then fed into the chart recorder 142. The depth signal from ultrasonic level measuring circuit 134 is also fed into level alarm 140 wherein it is compared to a particular depth value corresponding to the plow 122. If the plow 122 is fixed height, the comparator within level alarm 140 will simply use a signal representative of the fixed depth of the plow 122. Alternately, if the plow 122 is movable up and down by optional plow height control 132, a plow set signal is fed into the level alarm 140 for comparison purposes. In either case, the level alarm 140 will generate a digital validity signal having a true value if the depth signal indicates that the measured depth is the same as the depth set on the plow 122. If the comparison of the depth signal with the particular depth set on the plow 122 shows that the measured depth is less than the plow depth, the validity signal from level alarm 140 will be logically false.

As an alternative to recording the actual depth or level on the chart recorder 142, the validity signal from level alarm 140 on line 141 could be recorded if desired.

The gamma detector 128 feeds a gamma detect signal into gamma gauge density circuit 144. The gamma gauge density reading circuit 144 uses the gamma detect signal to generate a current density signal on line 146. This current density signal is simply a current which is proportional to the detected density of the granular material moving between the gamma source 126 and the gamma detector 128. The current density signal on line 146 is then fed into current to voltage converter 148 which generates a voltage density signal. The voltage density signal is fed into density meter 150 such that an operator can directly read the density of the granular material. Additionally, the density signal labelled FD is fed into a calculation circuit 152 wherein it is subtracted from a standard density signal SD supplied by density standard circuit 154, and this difference is divided by the density signal SD calculation circuit 152, like the other components within the present compactability system 100, can be readily constructed by those skilled in the art by using relatively standard building blocks. For example, an operational amplifier can be used for taking the difference between the SD and FD signals, the difference signal from the op amp and signal SD than being input to an Analog Device AD534 used as a divider.

The density signal FD represents the actual measured density of the granular material passing between the gamma source 126 and the gamma detector 128, this granular material being in a loose or uncompacted state. The density standard signal SD represents the density of a compacted amount of the same granular material as passing under the gamma source 126. As sand is passed through the foundry system and recycled repeatedly, its compacted density will usually remain approximately constant for a given type and mixture of sand and additives. However, the uncompacted or loose density of the sand has a tendency to degrade significantly as the sand is recycled. Accordingly, the compacted density may be represented by an empirically determined constant SD, whereas the density signal FD will track changes as sand ages and its uncompacted density generally becomes greater. Density standard circuit 154 may simply be a voltage source adjustable to output voltage based on the empirically determined constant SD. Once calibrated, the density standard circuit 154 would not likely need recalibration unless a significantly different type or mixture of sand is introduced into the system. The output of the calculation circuit 152 is a compactability signal of 0 to 10 volts which is proportional, or otherwise representative of, the percentage compactability resulting from the calculation of (SD-FD)/SD.

The compactability signal from the circuit 152 is directly readable on the compactability meter 153 in a similar fashion to the density meter 150 and the level meter 138. Additionally, the compactability signal is fed into the voltage to current converter 136 wherein it is converted into a current compactability signal C which is fed into chart recorder 142 for continuous tracking of its values. The current compactability signal C is fed into operational amplifiers 156A and 156B. The operational amplifiers also receive reference compactability values or signals CA and CB from potentiometers 158A and 158B. The operational amplifiers 156A and 156B serve to compare the actual compactability C with the reference compactability values CA and CB and output a signal to gate 159 depending upon the relative values of C, CA, and CB. The output of AND gate 159 will be logically true only if the measured compactability C is within the range determined by reference compactabilities CA and CB.

The gate 180 receives the output of gate 159 on line 157 and receives the validity signal from level alarm 140 as an input. The output of gate 180 is fed on line 110 into the control circuits 108A, 108B, and 112. Control circuits 108B and 112 are shown as block diagrams only, it being understood that they will be constructed in similar fashion to control 108A. In particular, control 108A includes a solid state relay 162 which receives the plow control signal on control line 110. The solid state relay 162 controls a solenoid 164, which in turn operates a normally closed air valve 166. The air valve 166 operates the plow 106A. A plow control circuit 168 operates the solid state relay 162, solenoid 164, air valve 166, and plow 106A in a manner generally conventional within the art. Basically, plow control 168 raises or lowers the plow 106A depending upon which of the molding machines 2 currently requires sand. If the molding machine 2 associated with conveyor belt 104A currently requires sand, the plow 106A will be lowered, thereby pushing sand onto conveyor 104A to feed the molding machine. Conversely, if the plow control 168 indicates that no sand is required on conveyor belt 104A for its molding machine, the plow 106A will be raised.

The difference between control 108A and the known prior art plow controls is that control 108A will cause the plow 106A to raise regardless of the signals from plow control 168 if the plow control line 110 indicates that the compactability of the sand is insufficient for proper molding. If the signal on plow control line 110 indicates that the compactability of the sand is acceptable, the plow control 168 will operate the plow 106A in conventional fashion. As an alternative to the arrangement shown for control 108A having the plow control signal feed into the solid state relay, the plow control signal could be one input to an AND gate, the other input being the signal from plow control 168.

The plow control signal on line 110 is preferably a digital signal indicating acceptability or unacceptability of the sand. The gate 180 would then be an AND gate and the comparing operational amplifiers 156A and 156B would function as comparators each having a digital output. If the validity signal from level alarm 140 indicated that the compactability signal was incorrect, the gate 180 would block any application of the output of comparator 156 to the plow control line 110. If the validity signal from level alarm 140 indicated a valid reading, the logical level on plow control line 110 would depend upon whether the comparator 156 indicated an acceptable compactability measurement.

For simplicity's sake, control 108B and control 112 are shown only in block form in FIG. 2 and the associated plows 106B and 114 are deleted therefrom. Although the controls 108B and 112 and plows 106B and 114 are substantially similar to that shown in detail for control 108A and plow 106A, control 112 would operate to lower the plow 114 if the plow control signal on line 110 indicated that the sand compactability was unacceptable. Referring back momentarily to FIG. 1, it will be seen that lowering the plow 114 will insure that the bad or unacceptable compactability sand is plowed onto conveyor belt 116 instead of recycling to the sand holding tank 55. Since the signal on plow control line 110 is a digital signal, the control 112 could simply use the same arrangement as the control unit 108A with a NOT gate inverting the signal on line 110.

An alternative to the arrangement shown in FIG. 1 would place the plow 114 and associated conveyor belt 116 upstream from the plows 106A and 106B and their respective associated conveyor belts 104A and 104B. If the plow 114 was situated upstream from plows 106A and 106B, the plow control signal on line 110 would not need to be fed into the control circuits 108A and 108B. That is, the plow 114 could simply plow all of the sand onto the bad sand conveyor belt 116 before any of the sand reached the plows 106A and 106B.

Operation and Method of the Invention

As shown in FIG. 1, the compactability system 100 is disposed to measure compactability of the sand or similar granular material passing on conveyor belt 102 on its way to the molding machines 2. The overall function of the present system is to display and record this compactability and, additionally, use the measured compactability value to control the operation of the plows 106A, 106B, and 114. If the compactability of the granular material is acceptable, one of the plows 106A and 106B could be lowered to supply sand to the associated molding machine 2. If the compactability indicates that the granular material is unacceptable, the plows 106A and 106B are both raised and plow 114 is lowered to insure that the unacceptable or bad sand is disposed by way of conveyor belt 116. If the sand is acceptable, but neither of the molding machines 2 (or other molding machines connected to receive sand from the mixer 1) currently requires sand, all of the plows 106A, 106B, and 114 will be raised to allow the sand from conveyor belt 102 to drop into the sand holding tank 55.

Returning to FIG. 2, the gamma source 126 and gamma ray detector 128 continuously measure the density of granular material passing therebetween. By subjecting the granular material on conveyor belt 102 to radiation from the gamma source 126 and detecting an amount of radiation which has passed through the granular material from the source 126, a gamma detect signal is produced. The detected radiation as represented by the gamma detect signal is fed into the gamma gauge density reading circuit 144 which derives a current density signal dependent on the density of the granular material. The current density signal on line 146 is converted into a voltage density signal by current to voltage converter 148. The voltage density signal FD is fed into calculation circuit 152 which operates on the density signal FD by subtracting it by the reference density value represented by the density standard SD and dividing the difference by SD. The divider 152 functions as a compactability signal generator and generates the compactability signal as an output thereto. It will be readily understood that the density standard could be adjustable depending upon the particular type and mixture of sand in use.

In addition to continuously measuring the compactability by way of the density detector including gamma source 126 and gamma detector 128, the compactability measurement measures the compactability of all the granular material which flows from the mixer 1 to the various molding machines 2. Further, the present continuous measurement of compactability is more broadly described as a measurement made in non-batch fashion meaning that the steps (subjecting to radiation, detecting the radiation, and generating the density signal) are not based on a batch of sand isolated from the rest of the sand. In other words, as used herein, non-batch fashion would include continuous steps (as in the preferred embodiment) and would include time-sampled steps as commonly used in clocked digital circuits.

The chart recorder 142 continuously records compactability C of the granular material.

Before the granular material is subjected to the gamma radiation, the granular material placed on conveyor belt 102 by sand mixer 1 is fluffed by aerator or fluffer 120, and plowed by plow 122 to a level at or below a particular depth.

In order to insure that the depth is as high as the particular depth set by the plow 122, the ultrasonic depth detector 124 and ultrasonic level measuring circuit 134 produced a depth signal depending on the detected depth. The level alarm circuit 140 serves as a validity signal generator to generate a digital signal having a first value indicating that the compactability signal is accurate when the depth signal indicates that the detected depth is at the particular depth and a second value indicating that the compactability signal is inaccurate when the depth signal indicates that the detected depth is below the particular depth. The level alarm circuit 140 would preferably include an actual alarm to alert the operator of the low depth.

Since the attenuation of the gamma rays from gamma source 126 through the granular material will be a function of the density and the depth of the granular material, the gamma gauge reading circuit 144 must be set in terms of the particular depth used for a fixed plow. The gamma gauge density reading circuit 144 alternately would receive the plow set signal of the optional plow height control 132, thereby insuring that changes in the depth of granular material do not result in uncalibrated and inaccurate density signals.

The compactability signal is used by way of the operational amplifiers 156A and 156B and gate 180 to control the flow of granular material from the mixer 1 to the molding machines 2. In particular, the current compactability signal values CA and CB are compared to the reference compactability C' in operational amplifiers 156A and 156B which feed gate 159. Gate 159 generates a comparison signal on line 157 based on this comparison. This comparison signal on line 157 passes through gate 180 if the validity signal has a logical true value, the output of gate 180 in turn controlling the flow of granular material by raising and lowering the plows 106A, 106B, and 114.

While the particular embodiments of the present invention have been described in detail, it will be apparent to those skilled in the art that various modifications thereof may be made without departing from the scope of the present invention. Accordingly, the scope of the present invention should be determined by reference to the appended claims.

What is claimed is:

1. A method comprising the steps of:

(a) subjecting granular material in a granular material casting foundry system to radiation from a radiation source, (b) detecting an amount of radiation which has passed through the granular material from the radiation source, (c) using the detected radiation to derive a density signal dependent on the density of the granular material, and (d) operating on the density signal with a reference density value to derive a compactability signal dependent on the compactability of the granular material.

2. The method of claim 1 wherein the granular material is subjected to the radiation as it is moving from a mixer to at least one molding machine.

3. The method of claim 1 further comprising the step of:

comparing the compactability signal to a reference compactability value and generating a comparison signal based on the comparison.

4. The method of claim 1 wherein the radiation is gamma radiation.

5. The method of claim 1 wherein the granular material is subjected to the radiation as it is moving from a mixer to at least one molding machine and the steps (a), (b), and (c) are performed in non-batch fashion.

6. The method of claim 5 further comprising step of:

continuously recording the compactability of granular material.

7. The method of claim 5 wherein the granular material is subject to the radiation as it is moving on a conveyor belt.

8. The method of claim 5 further comprising the step of:

using the compactability signal to control the flow of granular material from the mixer to the at least one molding machine.

9. The method of claim 8 wherein the use of the compactability signal to control the flow of granular material includes raising and lowering a plow depending on the compactability signal.

10. A method comprising the steps of:

(a) subjecting granular material in a granular material casting foundry system to radiation from a radiation source, (b) detecting an amount of radiation which has passed through the granular material from the radiation source, (c) using the detected radiation to derive a density signal dependent on the density of the granular material, and (d) operating on the density signal with a reference density value to derive a compactability signal dependent on the conpactability of the granular material, and wherein the granular material is subjected to the radiation as it is moving from a mixer to at least one molding machine and the steps (a), (b), and (c) are performed in non-batch fashion, and wherein the granular material is subjected to the radiation as it is moving on a conveyor belt, and further comprising, before the granular material is subjected to the radiation, the steps of:

placing the granular material on the conveyor belt, plowing the granular material to a level at or below a particular depth, detecting the depth after the plowing, and generating a depth signal depending on the detected depth.

11. The method of claim 10 further comprising the step of:

generating a digital validity signal having:

a first value indicating that the compactability signal is accurate when the depth signal indicates that the detected depth is at the particular depth, and a second value indicating that the compactability signal is inaccurate when the depth signal indicates that the detected depth is less than the particular depth.

12. The method of claim 10 wherein the step of detecting the depth includes directing ultrasonic waves towards the granular material and detecting reflected ultrasonic waves from the granular material.

13. A method comprising the steps of:

(a) measuring in a non-batch fashion the density of granular material in a granular material casting foundry system, (b) generating a density signal dependent on the density of the granular material as it is moving from a mixer to at least one molding machine, and (c) operating on the density signal with a reference density value to derive a compactability signal dependent on the compactability of the granular material.

14. The method of claim 13 further comprising the step of:

continuously recording the compactability of the granular material.

15. The method of claim 13 further comprising the step of:

comparing the compactability signal to a reference compactability value and generating a comparison signal based on the comparison.

16. The method of claim 13 wherein the density is measured by subjecting the granular material to radiation from a radiation source and detecting the amount of radiation which has passed through the granular material from the radiation source.

17. The method of claim 13 further comprising the step of:

using the compactability signal to control the flow of granular material from the mixer to the at least one molding machine.

18. The method of claim 17 wherein the use of the compactability signal to control the flow of granular material includes raising and lowering a plow depending on the compactability signal.

19. A method comprising the steps of:

(a) measuring in a non-batch fashion the density of granular material in a granular material casting foundry system, (b) generating a density signal dependent on the density of the granular material as it is moving from a mixer to at least one molding machine, (c) operating on the density signal with a reference density value to derive a compactability signal dependent on the compactability of the granular material, and (d) comparing the compactability signal to a reference compactability value and generating a comparison signal based on the comparison, and further comprising, before the granular material has its density measured, the steps of:

placing the granular material on the conveyor belt, plowing the granular material to a level at or below a particular depth, detecting the depth after the plowing, and generating a depth signal depending on the detected depth.

20. A compactability measurement system for use with a granular material casting foundry system, the compactability measurement system comprising:

(a) a density detector for detecting in a non-batch fashion the density of granular material as it is moving from a mixer to at least one molding machine of the foundry system, (b) a density signal generator connected to said density detector for generating a density signal dependent on the detected density, and (c) a compactability signal generator connected to receive said density signal generator for generating a compactability signal dependent on said density signal and a reference density value.

21. The compactability measurement system of claim 20 wherein said density detector comprises a radiation source and a radiation detector for detecting radiation which has passed through the granular material.

22. The compactability measurement system of claim 21 further comprising a flow controller for controlling the flow of granular material from the mixer to the at least one molding machine, said flow controller movable between different positions dependent on said compactability signal.

23. The compactability measurement system of claim 21 further comprising:

an aerator upstream from said density detector.

24. The compactability measurement system of claim 21 further comprising:

a comparison signal generator operative to receive said compactability signal, compare the compactability signal to a reference compactability value, and generate a comparison signal based on the comparison.

25. The compactability measurement system of claim 21 further comprising:

a recorder for continuously recording the compactability of the granular material.

26. A compactability measurement system for use with a granular material casting foundry system, the compactability measurement system comprising:

(a) a density detector for detecting in a non-batch fashion the density of granular material as it is moving from a mixer to at least one molding machine of the foundry system, (b) a density signal generator connected to said density detector for generating a density signal dependent on the detected density, and (c) a compactability signal generator connected to receive said density signal generator for generating a compactability signal dependent on said density signal and a reference density value, and wherein said density detector comprises a radiation source and a radiation detector for detecting radiation which has passed through the granular material, and wherein said density detector detects density of the granular material as it moves on a conveyor belt and the system further comprises:

a plow upstream from said density detector for plowing the granular material to a level at or below a particular depth, a depth detector between said plow and density detector for detecting the depth of said granular material, and a depth signal generator for generating a depth signal on the detected depth.

27. The compactability measurement system of claim 26 wherein said height detector includes an ultrasonic transmitter for directing ultrasonic waves at the granular material and an ultrasonic detector for detecting reflected ultrasonic waves from the granular material.

28. The compactability measurement system of claim 26 further comprising:

a validity signal generator for receiving said depth signal and generating a digital validity signal having a first value indicating that the compactability signal is accurate when the depth signal indicates that the detected depth is at the particular depth and a second value indicating that the compactability signal is inaccurate when the depth signal indicates that the detected depth is below the particular depth.

* * * * *